US009819076B2

(12) United States Patent
Koo

(10) Patent No.: US 9,819,076 B2
(45) Date of Patent: Nov. 14, 2017

(54) INTENNA MANUFACTURING METHOD HAVING CAPABILITY TO IMPROVE PLATING RELIABILITY

(71) Applicants: INTOPS. CO., LTD., Gyeonggido (KR); Bon-sool Koo, Gyeonggi-do (KR)

(72) Inventor: Bon-sool Koo, Gyeonggi-do (KR)

(73) Assignees: INTOPS.CO., LTD., Anyang-si (KR); Bon-Sool Koo, Anyang-si (KR)

( * ) Notice: Subject to any disclaimer, the term of this patent is extended or adjusted under 35 U.S.C. 154(b) by 40 days.

(21) Appl. No.: 14/895,491

(22) PCT Filed: Aug. 26, 2013

(86) PCT No.: PCT/KR2013/007624
§ 371 (c)(1),
(2) Date: Jan. 25, 2016

(87) PCT Pub. No.: WO2014/196692
PCT Pub. Date: Dec. 11, 2014

(65) Prior Publication Data

US 2016/0149294 A1 May 26, 2016

(30) Foreign Application Priority Data

Jun. 3, 2013 (KR) ..... 10-2013-0063464

(51) Int. Cl.
*H01Q 1/38* (2006.01)
*C25D 7/00* (2006.01)
(Continued)

(52) U.S. Cl.
CPC ..... *H01Q 1/38* (2013.01); *C23C 18/16* (2013.01); *C23C 28/023* (2013.01); *C25D 5/024* (2013.01);
(Continued)

(58) Field of Classification Search
CPC . C25D 5/024; C25D 5/34; C25D 5/48; C25D 7/00; C23C 18/16; C23C 28/023; H01Q 1/38; H01Q 1/243
See application file for complete search history.

(56) References Cited

U.S. PATENT DOCUMENTS 8,722,539 B2 * 5/2014 Reid ..... C25D 3/38 257/E21.586
2002/0011415 A1 * 1/2002 Hey ..... C25D 5/10 205/104

FOREIGN PATENT DOCUMENTS

JP 01236246 * 9/1989 ..... C08J 7/00
KR 1020060098042 * 11/2007 ..... H01Q 1/24
(Continued)

OTHER PUBLICATIONS

International Search Report for PCT/KR2013/007624 dated Oct. 30, 2013 from Korean Intellectual Property Office.

*Primary Examiner* — Louis J Rufo
(74) *Attorney, Agent, or Firm* — KORUS Patent, LLC; Seong Il Jeong

(57) ABSTRACT

The present invention relates to a method for manufacturing an internal antenna (intenna) and, in particular, to a method for manufacturing an intenna, which allows a resin molded product to be smoothly and securely plated with a metal by applying a primer paint on the surface of the resin molded product, and thereby improves the reliability of the metal plating formed on the resin molded product.

2 Claims, 12 Drawing Sheets

(51) Int. Cl.

| | |
|---|---|
| ***C25D 5/48*** | (2006.01) |
| ***C25D 5/34*** | (2006.01) |
| ***C23C 28/02*** | (2006.01) |
| ***C23C 18/16*** | (2006.01) |
| ***C25D 5/02*** | (2006.01) |
| ***H01Q 1/24*** | (2006.01) |

(52) U.S. Cl.
CPC ..... *C25D 5/34* (2013.01); *C25D 5/48* (2013.01); *C25D 7/00* (2013.01); *H01Q 1/243* (2013.01)

(56) References Cited

FOREIGN PATENT DOCUMENTS

| | | | | |
|---|---|---|---|---|
| KR | 10-2008-0050917 | A | | 6/2008 |
| KR | 20080050917 | A | * | 6/2008 |
| KR | 10-2011-0115747 | A | | 10/2011 |
| KR | 10-2011-0123872 | A | | 11/2011 |
| KR | 10-1167570 | B1 | | 8/2012 |
| KR | 10-1250644 | B1 | | 4/2013 |
| KR | 101374150 | B1 | * | 3/2014 |

* cited by examiner

【FIG.1】
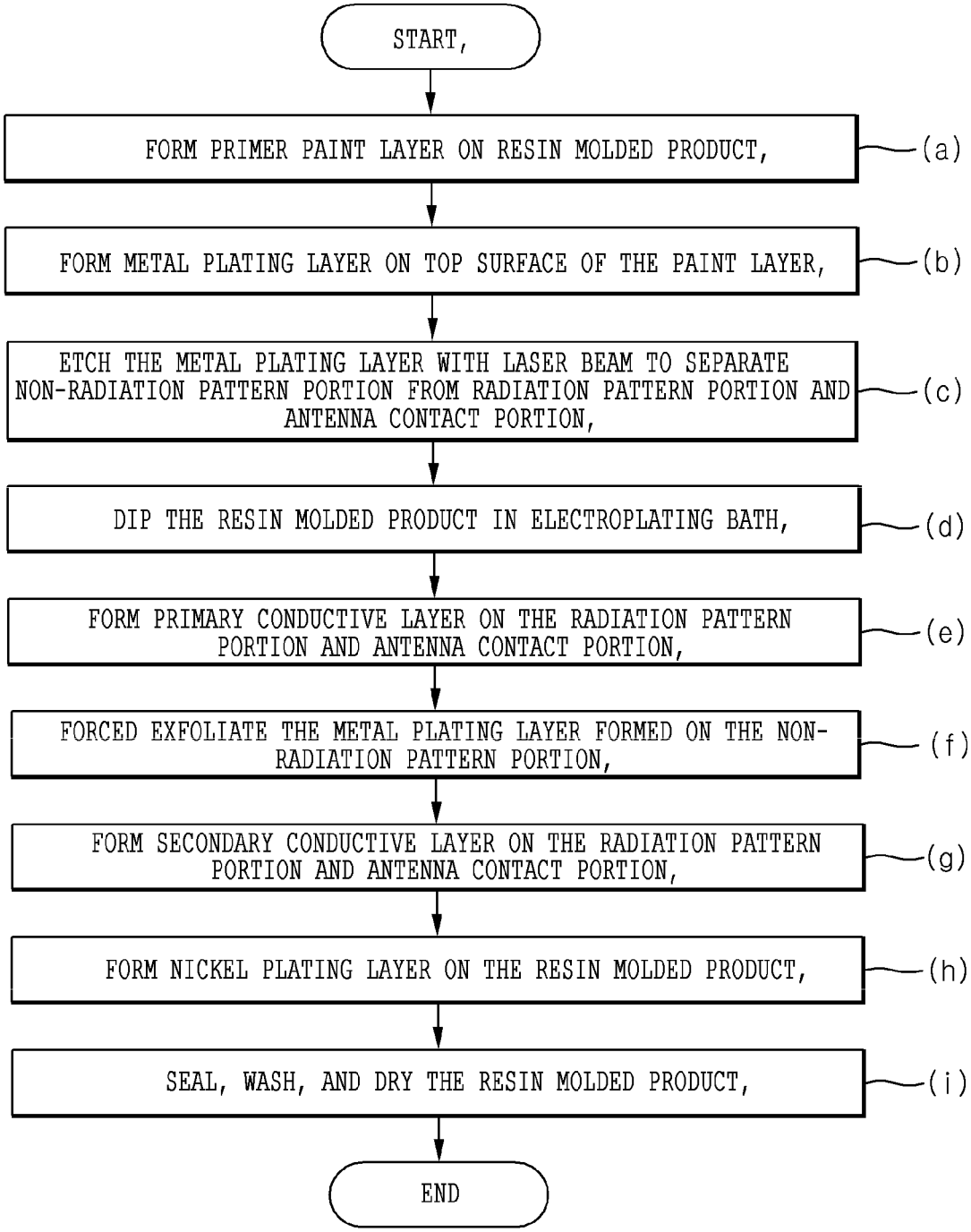

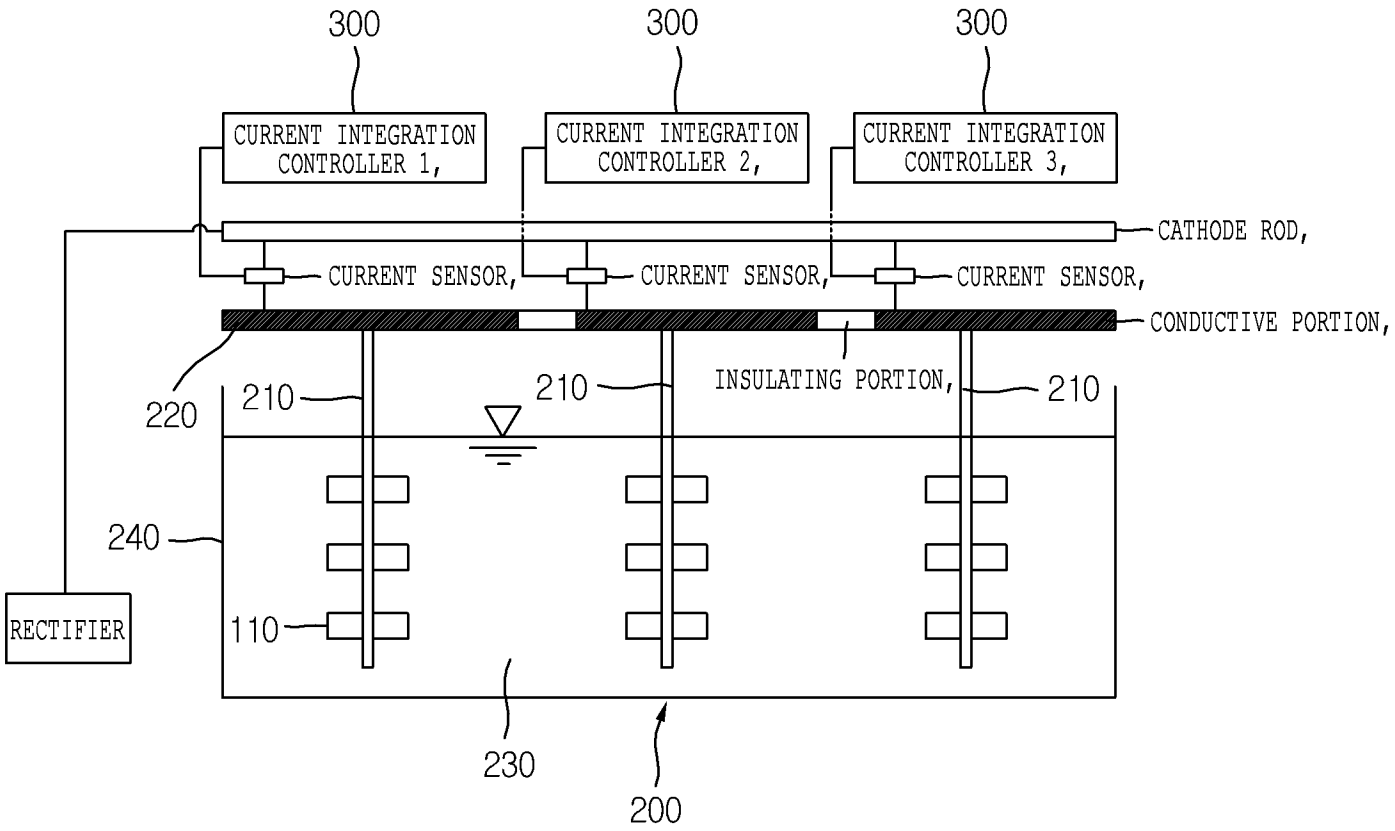
【FIG.2】

【FIG.3】
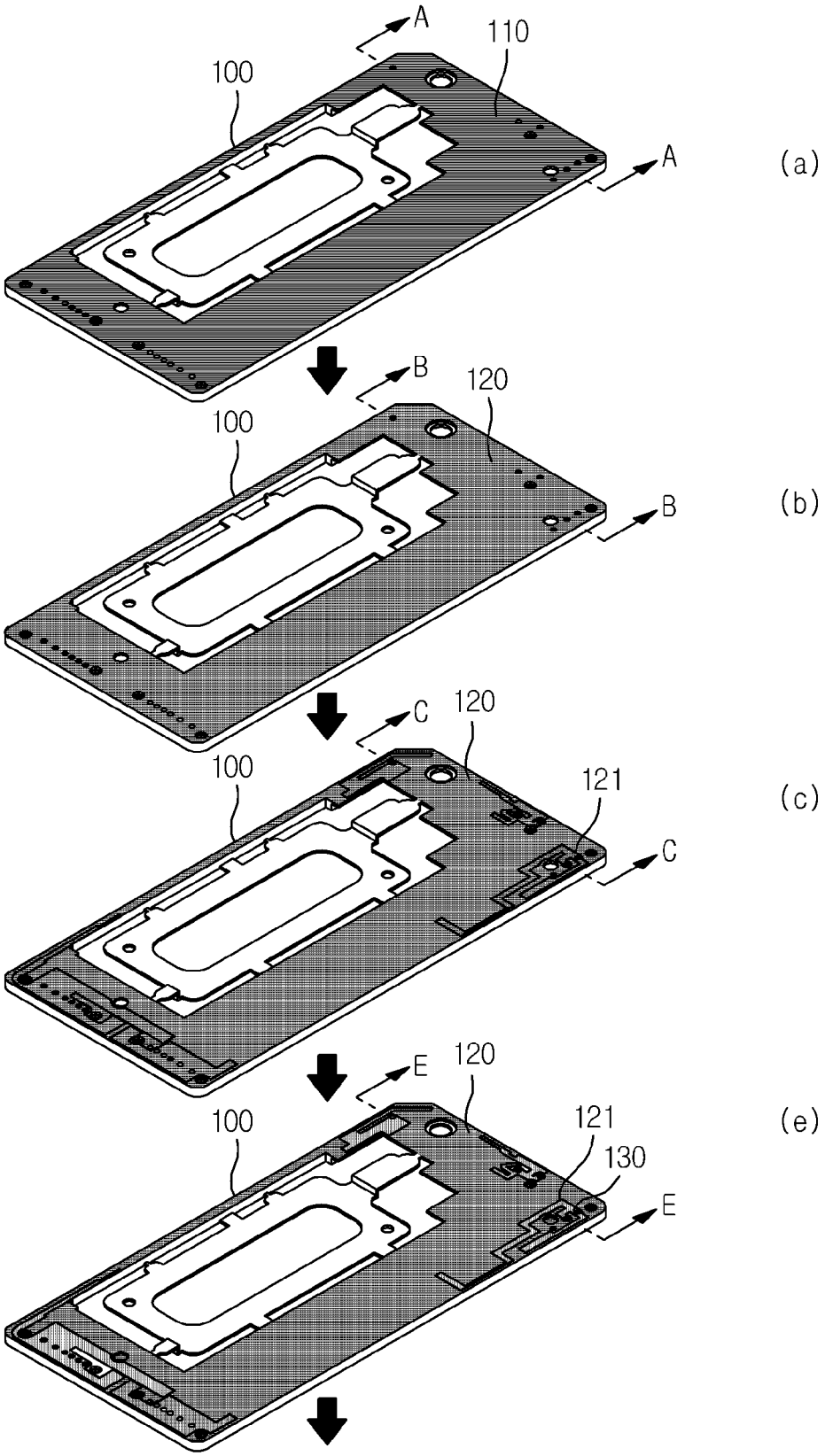

【FIG.4】
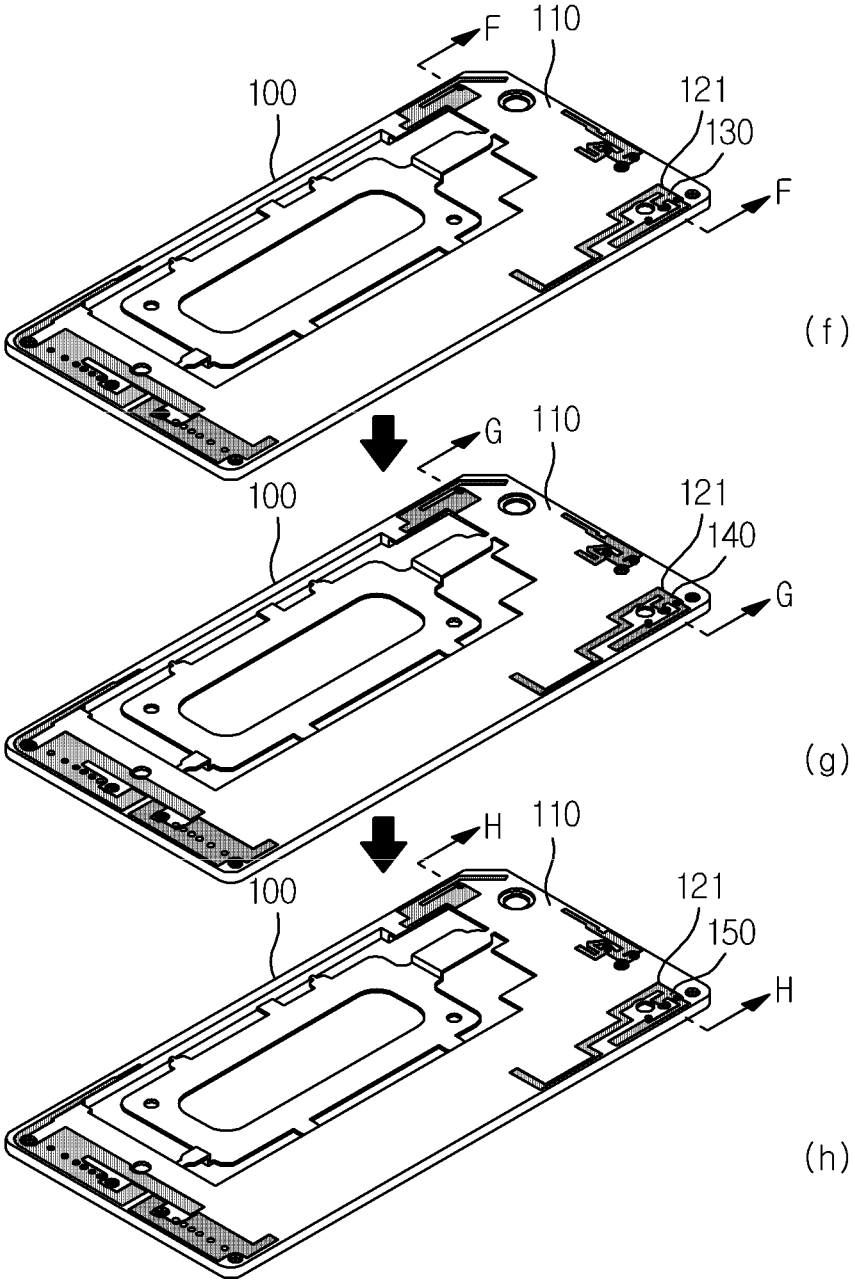

【FIG.5】
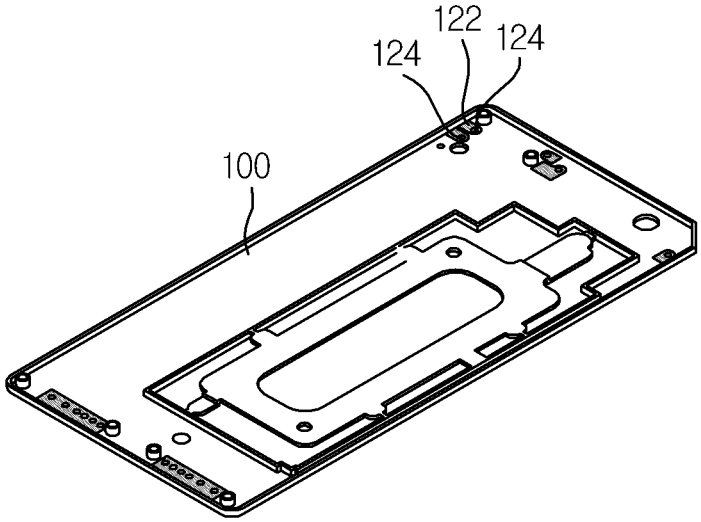

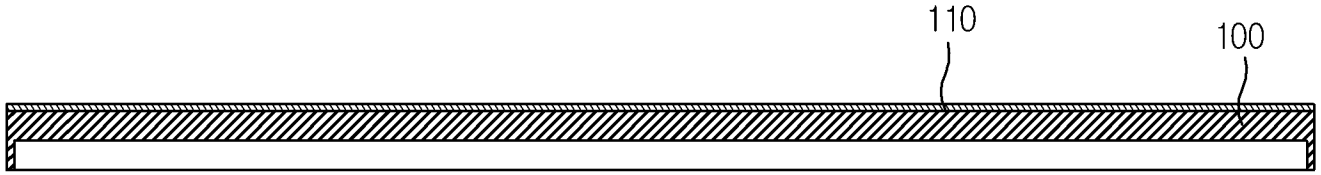
【FIG.6】

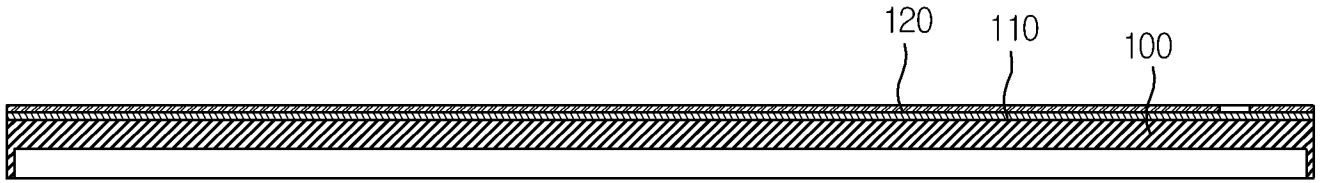
【FIG.7】

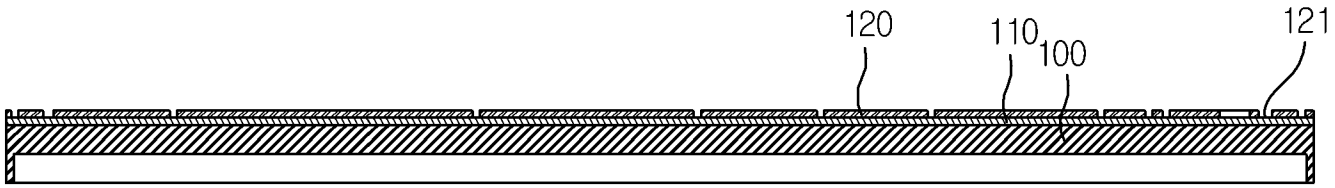
【FIG.8】

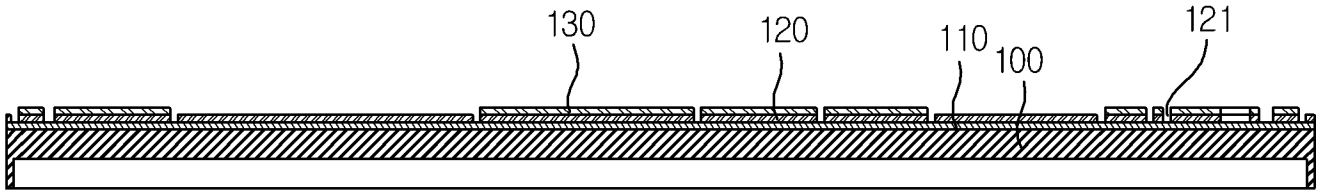
【FIG.9】

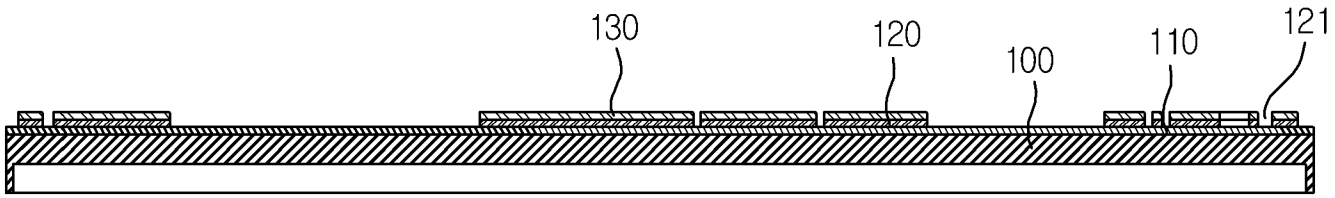
【FIG.10】

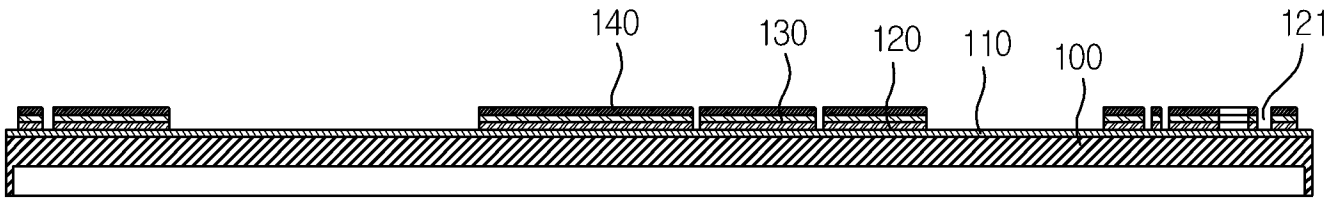
【FIG.11】

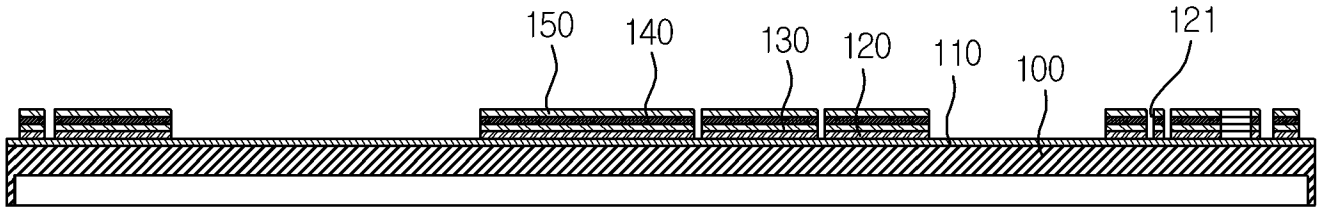
【FIG.12】

INTENNA MANUFACTURING METHOD HAVING CAPABILITY TO IMPROVE PLATING RELIABILITY

CROSS REFERENCE TO PRIOR APPLICATIONS

This application is a National Stage Application of PCT International Patent Application No. PCT/KR2013/007624 filed on Aug. 26, 2013, under 35 U.S.C. §371, which claims priority to Korean Patent Application No. 10-2013-0063464 filed on Jun. 3, 2013, which are all hereby incorporated by reference in their entirety.

TECHNICAL FIELD

The present disclosure relates to a method of manufacturing an intenna, and more particularly, to a method of manufacturing an intenna which may improve the reliability of a plating, which is formed on a resin molded product, by coating a surface of the resin molded product with a primer paint to form a smooth and robust plating on the resin molded product.

BACKGROUND ART

In general, an intenna for facilitating wireless transmission and reception is formed in a wireless communication device such as a mobile phone.

With respect to the wireless communication device such as a mobile phone, since the thickness of an external case, in which an intenna as well as built-in components is formed, has been continuously decreased for convenience of carry and miniaturization, the case is relatively vulnerable to an external impact, and thus, it is a major cause of damage.

Accordingly, there is a need to develop a material of the case and a manufacturing method which may easily form an intenna in addition to produce the case with a thin profile and minimize the damage from the external impact, and thus, cases of various materials and methods of manufacturing an intenna have been proposed.

However, a typical material of the case of the wireless communication device, such as a mobile phone, is mainly formed of a mixture of acrylonitrile butadiene styrene (ABS) copolymer and polycarbonate resin, a polycarbonate resin, a mixture of ABS copolymer, polycarbonate resin, and glass fibers, or a mixture of polycarbonate and glass fibers in order to reinforce the strength of the case. Since plating is not smoothly performed on such a resin material, reliability of plating is not sufficiently obtained due to a decrease in plating adhesion of an intenna manufactured by a plating method. Thus, excessive defects and antenna performance degradation may occur.

Also, as can be seen in Korean Patent Application No. 10-2010-0043328 (method of manufacturing an intenna having a uniform plating layer) filed on May 10, 2010 by the present applicant as a typical method of manufacturing an intenna, the thickness of a plating layer formed on a radiation pattern portion and an antenna contact portion may be uniformly formed without deviation by particularly detecting the amount and value of applied current in real time to interrupt electrical supply or to sound an alarm when the desired thickness of plating is obtained through the integration of plating time. However, plating adhesion is also not perfect, and productivity may not only be reduced because excessive working time is required to remove a metal plating layer which is coated on a non-radiation pattern portion excluding the radiation pattern portion and the antenna contact portion, but all reliability items required for mobile phone brands may also be difficult to be satisfied.

DISCLOSURE OF THE INVENTION

Technical Problem

The purpose of the present invention is to provide a method of manufacturing an antenna which may improve reliability during plating by coating the surface of a resin molded product, which is used as a material of a case of a wireless communication device such as a mobile phone, with a primer paint.

The purpose of the present invention is also to provide a method of manufacturing an antenna which may improve productivity by significantly reducing the working time while preventing quality degradation by forced chemical exfoliation of a metal plating layer formed on a non-radiation pattern portion and compensating damage at the same time.

Technical Solution

According to an embodiment of the present invention, there is provided a method of manufacturing an intenna by using electroplating including: (a) forming a paint layer on a resin molded product with a primer paint; (b) forming a metal plating layer on a top surface of the paint layer; (c) etching the metal plating layer with a laser beam so that a radiation pattern portion and an antenna contact portion are formed to be electrically separated from a non-radiation pattern portion; (d) hanging the resin molded product, which is laser-etched to allow the radiation pattern portion and the antenna contact portion to be electrically separated from the non-radiation pattern portion, on a hanger and dipping the resin molded product in an electroplating bath; (e) forming a primary conductive layer on the radiation pattern portion and the antenna contact portion; (f) forced exfoliating the metal plating layer formed on the non-radiation pattern portion excluding the radiation pattern portion and the antenna contact portion; (g) forming a secondary conductive layer on the radiation pattern portion and the antenna contact portion; (h) forming an electrolytic nickel plating layer on the radiation pattern portion and the antenna contact portion on which the secondary conductive layer is formed; and (i) sealing, washing, and drying the resin molded product on which the nickel plating layer is formed.

The paint is composed of 30 wt % to 40 wt % of acetone, 30 wt % to 40 wt % of methyl ethyl ketone, 10 wt % to 20 wt % of cyclohexanone, and 10 wt % to 20 wt % of an acrylonitrile butadiene styrene (ABS) copolymer or a liquid crystal polymer (LCP) resin.

In the step (c), a distance between the non-radiation pattern portion and the radiation pattern portion and antenna contact portion is formed to be in a range of 100 μm to 200 μm to prevent a failure due to a short-circuit phenomenon during electroplating.

The forced exfoliating of the metal plating layer in the step (f) is performed by chemical exfoliation including sulfuric acid and hydrogen peroxide, instead of electrolytic exfoliation.

Advantageous Effects

As described above, since plating adhesion to various resin materials may be improved during the manufacture of an intenna, a uniform and robust plating may be obtained to improve reliability.

Also, since the manufacturing time of the intenna may be significantly reduced, productivity may be improved and costs may be reduced.

Furthermore, a short-circuit phenomenon occurred during electroplating may be certainly prevented by increasing a distance between a non-radiation pattern portion and radiation pattern portion and antenna contact portion.

BRIEF DESCRIPTION OF THE DRAWINGS

FIG. 1 is a flowchart illustrating a sequence of a method of manufacturing an intenna according to an exemplary embodiment of the present invention;

FIG. 2 schematically illustrates an overall configuration of an electroplating apparatus connected to current integration controllers according to the method of manufacturing an intenna of the present invention;

FIGS. 3 and 4 schematically illustrate a sequence of forming a radiation pattern portion and an antenna contact portion, as an intenna according to the present invention, on a resin molded product constituting a case of a wireless communication device such as a mobile phone;

FIG. 5 schematically illustrates an antenna contact portion formed on a rear surface (inner surface) of a resin molded product according to the present invention;

FIG. 6 is an enlarged schematic cross-sectional view taken along line A-A of FIG. 3;

FIG. 7 is an enlarged schematic cross-sectional view taken along line B-B of FIG. 3;

FIG. 8 is an enlarged schematic cross-sectional view taken along line C-C of FIG. 3;

FIG. 9 is an enlarged schematic cross-sectional view taken along line E-E of FIG. 3;

FIG. 10 is an enlarged schematic cross-sectional view taken along line F-F of FIG. 4;

FIG. 11 is an enlarged schematic cross-sectional view taken along line G-G of FIG. 4; and FIG. 12 is an enlarged schematic cross-sectional view taken along line H-H of FIG. 4.

MODE FOR CARRYING OUT THE INVENTION

Hereinafter, an exemplary embodiment of a method of manufacturing an intenna having improved reliability of plating, according to the present invention, will be described in more detail with reference to the accompanying drawings.

Herein, elements having the same functionality in the following drawings are provided with the same reference numbers and repeated descriptions are omitted. In addition, terms used herein are defined in consideration of functions in the present invention, and therefore, the terms will be construed based on common meanings.

As illustrated in FIGS. 1 to 12, the present invention includes the steps of: (a) forming a paint layer 110; (b) forming a metal plating layer 120; (c) etching with a laser beam; (d) dipping in an electroplating bath; (e) forming a primary conductive layer; (f) forced exfoliating the metal plating layer; (g) forming a secondary conductive layer; (h) forming a nickel plating layer; and (i) sealing, washing, and drying.

The step (a) of forming a paint layer 110 by coating a resin molded product 100 with a primer paint is to obtain a smooth and robust plating during the formation of the metal plating layer 120 on a top surface of the paint layer 110.

That is, since a material of cases of mobile phones or other wireless communication devices mainly formed by injection molding is composed of a mixture of acrylonitrile butadiene styrene (ABS) copolymer and polycarbonate resin, polycarbonate, a mixture of ABS copolymer, polycarbonate resin, and glass fibers, or a mixture of polycarbonate and glass fibers, a plating is not smoothly and rigidly formed on the material other than an ABS copolymer or a liquid crystal polymer (LCP) resin when an intenna is manufactured by using an electroplating method. Thus, in order to address the above limitation, the paint layer 110 is formed by coating the primer paint.

The paint is composed of 30 wt % to 40 wt % of acetone, 30 wt % to 40 wt % of methyl ethyl ketone (MEK), 10 wt % to 20 wt % of cyclohexanone, and 10 wt % to 20 wt % of an ABS copolymer or a LCP resin.

Herein, in a case in which the acetone is added in an amount of 30 wt % or less, dissolution efficiency of the ABS copolymer or LCP resin may be reduced, and, in a case in which the acetone is added in an amount of 40 wt % or more, since the paint is vulnerable to moisture, adhesion as well as transparency may be reduced.

Also, in a case in which the methyl ethyl ketone is added in an amount of 30 wt % or less, dissolution efficiency of the ABS copolymer or LCP resin may be reduced, and, in a case in which the methyl ethyl ketone is added in an amount of 40 wt % or more, adhesion between the resin molded product 100 and the paint may be reduced.

Furthermore, in a case in which the cyclohexanone is added in an amount of 10 wt % or less, since a concentration of the paint is low, the paint dries so quickly during spraying that leveling (smoothing microscopic irregularities or streaks (file marks) by electroplating) is not good, and, in a case in which the cyclohexanone is added in an amount of wt % or more, drying time after the spraying may be excessively increased.

In a case in which the ABS copolymer or LCP resin is added in an amount of 10 wt % or less, since the concentration is low (dilute), a coating having a desired thickness may be difficult to be formed.

In a case in which the ABS copolymer or LCP resin is added in an amount of 20 wt % or more, since the concentration is high, dissolution efficiency of the ABS copolymer or LCP resin is above a critical point. Thus, the spraying may not be performed properly due to some undissolved resin particles and uniform particles may also be difficult to be formed.

Also, a thickness of the paint thus configured and coated on the resin molded product may be in a range of 6 μm to 16 μm, but the thickness may be varied if necessary.

The paint layer 110 thus coated may be forced-dried at a temperature of 60° C. to 80° C.

Furthermore, in a case in which an operating temperature of the paint is 85° C. or less, the ABS copolymer, which may be used in a relatively low temperature, may be used, and, in a case in which the operating temperature of the paint is in a range of 85° C. or more to 240° C. or less, the LCP resin, which may be used in a relatively high temperature, may be used.

That is, when an intenna is formed on the surface of the resin molded product 100 constituting a case of a wireless communication device, such as a mobile phone, and used, or when its reliability test is performed at 85° C. or less, it is desirable to use the ABS copolymer.

Also, when the reliability test requires a temperature of 85° C. or more, it is desirable to use the LCP resin.

In a case in which an intenna is formed on an inner surface of the resin molded product 100 constituting the case of the wireless communication device such as a mobile phone, since the intenna is primarily formed on the surface of the resin molded product 100 and may then be covered with a resin by injection molding, the paint must withstand injection temperature (about 220° C. to 240° C.) and pressure. Thus, in this case, the LCP resin is also used.

The step (b) is a step of forming the metal plating layer 120 on the paint layer 110 of the resin molded product 100, wherein the metal plating layer 120 for electrical conduction (current is generated while a charge moves when an electric field is present inside a conductor, wherein the charge includes an electron or ion, and since the electron is light, electron conduction has a significant effect on electrical conductivity) is formed on the entire surface of the resin molded product 100, as an insulator, by using a coating material, such as copper, nickel, and a nickel alloy, which is easily dissolved by an acidic plating solution or a component during electroless plating (method of precipitating metal on the surface of a workpiece by self-catalytic reduction of metal ions in a metal salt aqueous solution using a reducing agent without external electrical energy).

Also, the metal plating layer 120 may be formed to a thickness of 0.1 μm to 0.5 μm which is suitable to etch a radiation pattern portion 121 and an antenna contact portion 122 for antenna function with a laser beam.

In the step (c), the radiation pattern portion 121 and the antenna contact portion 122 for antenna function are formed to be electrically separated from a non-radiation pattern portion 123 (all portions excluding the radiation pattern portion and the antenna contact portion) by etching the surface of the metal plating layer 120, which is formed on a rear surface and a front surface of the resin molded product 100 by the electroless plating, with a laser beam.

That is, a boundary between the non-radiation pattern portion 123 and the radiation pattern portion 121 and antenna contact portion 122 is divided by etching with a laser beam so that electricity is provided only to the radiation pattern portion 121 and the antenna contact portion 122 which are electrically separated from the non-radiation pattern portion 123 and require plating.

In this case, a distance between the non-radiation pattern portion 123 and the radiation pattern portion 121 and antenna contact portion 122 may be formed to be in a range of 100 μm to 200 μm so as to prevent a failure due to a short-circuit phenomenon during electroplating.

Accordingly, during the electroplating, the plating is performed by allowing electricity to flow through only the radiation pattern portion 121 and the antenna contact portion 122, and since electricity does not flow through the non-radiation pattern portion 123, the plating is not performed.

The above-described laser etching is one method of forming or surface machining caused by the corrosive action of chemicals, wherein, as a process of forming micro anchor holes so as to obtain cohesion which is required for the metal plating layer 120 electroplated on the surface of the resin molded product 100 to stably maintain adhesion without separation, it is considered to be additional to the formation of the paint layer 110.

Accordingly, after the conductive layer is formed on the radiation pattern portion 121 and the antenna contact portion 122 to a sufficient thickness by the electroplating, the metal plating layer 120 for electrical conduction stably maintains antenna function without exfoliation even under various poor thermal and mechanical conditions which may occur in the actual use environment of an antenna.

The laser etching process is very important in terms of smoothly and well maintaining the function of the antenna.

The radiation pattern portion 121 and the antenna contact portion 122 are fixed to a contact of an electroplating hanger 210.

In this case, one point of the radiation pattern portion 121 and one or more points including the antenna contact portion 122 may be used as a portion to which the electrical contact of the electroplating hanger 210 may be fixed, and a through hole 124 having a diameter of 0.5 mm to 2 mm, which may electrically connect between the conductive radiation pattern portion 121 disposed on a front surface portion of the resin molded product 100 and the antenna contact portion 122 disposed on a rear surface portion of the resin molded product 100, may be secured and the electrical contact of the electroplating hanger 210 may be inserted into the through hole.

That is, the contact of the electroplating hanger 210 is fixed by being inserted into an inner surface of the through hole 124 which is secured to electrically connect the radiation pattern portion 121 disposed on the front surface portion of the resin molded product 100 and the antenna contact portion 122 disposed on the rear surface portion.

The step (d) is a step of hanging the resin molded product 100 including the radiation pattern portion 121 and the antenna contact portion 122, which are laser-etched to be electrically separated from the non-radiation pattern portion 123, on the electroplating hanger 210 and dipping in an electroplating bath 240, wherein the plurality of electroplating hangers 210 is connected to current integration controllers 300 and is then immersed in the electroplating bath 240 filled with a plating solution 230 of an electroplating apparatus 200.

That is, the plurality of electroplating hangers 210, to which the radiation pattern portion 121 and the antenna contact portion 122 of the resin molded product 100 are fixed, is connected to the current integration controllers 300, which may detect a current flow in real time and may accurately and uniformly control a total supply current required between the electroplating hangers 210, and is immersed in the electroplating bath 240 installed in the electroplating apparatus 200.

In this case, the conductive metal radiation pattern portion 121, to which the contact of the electroplating hanger 210 is fixed, and the antenna contact portion 122 electrically connected thereto are electroplated by using the current integration controllers 300, wherein supply time of the current, which is supplied when the thickness of the conductive layer is increased, is not set to a separate fixed value, but an integrated value, in which the current and plating time are multiplied, is set to be proportional to the number of products for each electroplating hanger 210, and electrical supply is interrupted or an alarm is sounded when the desired thickness of plating is obtained at the set integrated current value. Thus, a deviation of the plating thickness between the electroplating hangers 210 may be minimized without being affected by a deviation of current flowing in each part of the plating bath 240 and excessive or insufficient plating occurred during the plating due to variable electrical conditions, a ripple of the supply current in the plating bath, an installation distance between anode rods, a slope, density of the anode rods, and changes in resistance depending on the concentration and flow of the plating solution.

Herein, the electroplating apparatus 200 is configured by including a rectifier supplying a direct current, an anode rod (not shown) distributing the direct current, and a rack 220 which may hold the anode rod, copper or nickel used as a typical electroplating anode material, a cathode rod distributing a cathode current, and the electroplating hangers 210 and may separately supply electricity thereto.

Also, the current integration controller 300 is configured by including current detection sensor sensing the amount of current supplied to each electroplating hanger 210 in real time, a microprocessor and a peripheral circuit which indicate the current status of the target thickness of plating desired by a user through the integration of a current value sensed by the current detection sensor with plating time, and a liquid crystal display (LCD) unit having a buzzer which displays the current status.

The current integration controller 300 thus configured is connected to each rack 220 of the electroplating apparatus 200 and operates individually.

The step (e) is a step of forming a primary conductive layer 130 on the radiation pattern portion 121 and the antenna contact portion 122, wherein the primary conductive layer 130 is formed on the radiation pattern portion 121 and the antenna contact portion 122 of the resin molded product 100 to a set thickness (about 15 μm) through electrolytic copper plating by supplying a current to each electroplating hanger 210 which is immersed in the plating solution 230 contained in the electroplating bath 240.

In this case, the metal plating layer 120 formed on the non-radiation pattern portion 123 is partially exfoliated.

The step (f) is a step of forced exfoliating the metal plating layer 120, which is formed on the non-radiation pattern portion 123 excluding the radiation pattern portion 121 and the antenna contact portion 122 and is not exfoliated, completely, wherein forced chemical exfoliation of the metal plating layer 120, which is formed on the non-radiation pattern portion 123 excluding the radiation pattern portion 121 and the antenna contact portion 122 by electroless plating, is completely performed by dipping the resin molded product 100 in an exfoliation bath (not shown), in which sulfuric acid and hydrogen peroxide are mixed in a ratio of 1:1, for about 1 minute to about 5 minutes.

Thus, an improvement in productivity may be maximized by significantly reducing the working time through the rapid removal of the metal plating layer 120, which is formed on the unnecessary portion by the electroless plating, within about 1 minute to about 5 minutes in comparison to a case in which the non-radiation pattern portion 123 is typically slowly exfoliated for a relatively long period of time of about 40 minutes to about 60 minutes by sulfuric acid filled in the electroplating bath 240.

The step (g) is a step of forming a secondary conductive layer 140 on the radiation pattern portion 121 and the antenna contact portion 122 of the resin molded product 100 from which the metal plating layer 120 of the non-radiation pattern portion 123 is exfoliated, wherein the secondary conductive layer 140 is formed on the radiation pattern portion 121 and the antenna contact portion 122 to a set thickness (about 0.5 μm to 2 μm) through electrolytic copper plating by supplying a current to each electroplating hanger 210 which is immersed in the plating solution 230 of the electroplating bath 240.

Thus, after the primary conductive layer 130 is secured in the step (e), the forced complete exfoliation of the metal plating layer 120, which is formed by the electroless plating, of the non-radiation pattern portion 123 is performed and the secondary conductive layer 140 is then formed. When the forced exfoliation of the metal plating layer 120 is performed and nickel electroplating is then performed, a chemical coating layer formed during the exfoliation of the metal plating layer 120 prevents adhesion to electric nickel, and thus, a layer separation phenomenon between copper and nickel may occur.

The secondary conductive layer 140 is formed to remove the layer separation phenomenon between copper and nickel and compensate the copper plating of the radiation pattern portion 121 which is partially damaged during the forced exfoliation of the metal plating layer 120 of the non-radiation pattern portion 123.

The step (h) is a step of forming an electrolytic nickel plating layer 150 on the radiation pattern portion 121 and the antenna contact portion 122 on which the secondary conductive layer 140 is formed, wherein the electrolytic nickel plating layer 150 is formed on the radiation pattern portion 121 and the antenna contact portion 122 to a set thickness through electrolytic nickel plating by supplying a current to each electroplating hanger 210 which is immersed in the plating solution 230 of the electroplating bath 240.

The step (i) is a step of sealing, washing, and drying the resin molded product 100 having the nickel plating layer 150 formed thereon, wherein anti-corrosive effect is enhanced by treating the resin molded product 100 with a sealing agent after the plating because plating pin holes exist, drying may be performed at a relatively low temperature in order to prevent deformation of the resin molded product 100 or peeling-off of the plating layer caused by heating, and moisture on the surface of the product may be removed by hot air drying or dehydration drying in a temperature range of about 40° C. to about 60° C.

Thus, in order to form an intenna, the formation of the radiation pattern portion 121 and the antenna contact portion 122 for electrical conduction on the resin molded product 100 by electroplating may be performed through processes, such as degreasing→etching→neutralization→activation 1→activation 2→electroless copper or electroless nickel plating, as in typical decorative plastic plating.

The method of manufacturing an intenna having improved reliability of plating according to the embodiment of the present invention, which is configured as described above, will be described in more detail as follows.

EXAMPLE 1

First, a resin molded product 100, as an intenna injection molded from a material, such as a mixture of acrylonitrile butadiene styrene (ABS) copolymer and polycarbonate resin, polycarbonate, a mixture of ABS copolymer, polycarbonate resin, and glass fibers, or a mixture of polycarbonate and glass fibers, was degreased with a typical solution for degreasing plastic at 50° C. for 5 minutes to remove foreign matter on the surface thereof, immersed in 500 g/l of chromic acid anhydride and 200 ml/l of sulfuric acid at 72° C. for 12 minutes, and washed with water. Then, a paint layer 110 was formed by uniformly coating the resin molded product 100 to a thickness of 6 μm to 16 μm by using a primer paint which is composed of 30 wt % to 40 wt % of acetone, 30 wt % to 40 wt % of methyl ethyl ketone (MEK), 10 wt % to 20 wt % of cyclohexanone, and 10 wt % to 20 wt % of an ABS copolymer or a LCP resin (a).

The resin molded product 100 having the paint layer 110 formed thereon was forced-dried at a temperature of 60° C. to 80° C.

The resin molded product 100 having the paint layer 110 formed thereon was treated with a solution, in which 2.5 wt % of a neutralizing solution, in which 18 wt % of hydroxylamine sulfate and 82 wt % of distilled water were mixed, 10 wt % of 35% hydrochloric acid, and 8.7 wt % of water were mixed, at about 60° C. for 5 minutes, and was then neutralized by washing with water.

The resin molded product 100 subjected to the neutralization treatment was subjected to a primary activation treatment by performing an activation treatment with 100 cc/l of a catalyst-imparting solution, in which 0.2 g/l of palladium chloride ($PdCl_2$) and 520 g/l of stannous chloride ($SnCl_2$) were mixed, and 100 cc/l of hydrochloric acid for 10 minutes and washing four times with water, and the resin molded product 100 was then subjected to a secondary activation treatment by performing an activation treatment with 5% sulfuric acid at 40° C. for 10 minutes and washing three times with water.

The resin molded product 100 subjected to the activation treatments was electroless plated in a commercial standard chemical copper plating solution including copper sulfate for 3 minutes to form a metal plating layer 120 to a thickness of 0.1 μm to 0.5 μm (b).

As a result of forming the paint layer 110 by coating the resin molded product 100 with the above-described primer paint and then forming the metal plating layer 120 thereon, since a smooth and robust plating was formed by being closely attached to a molded product which is formed of a resin, such as polycarbonate (PC) and PC+glass fiber (glass fiber content up to 60%), in addition to an ABS+PC resin, reliability items of the intenna, which were required for brands of wireless communication devices such as mobile phones, may all be satisfied.

Next, the resin molded product 100, on which the metal plating layer 120 was formed by the electroless copper plating, was dehydration dried while supplying hot air to maintain an inner temperature of 60° C., and the surface of the metal plating layer 120 was then etched by using a laser beam so that a radiation pattern portion 121, an antenna contact portion 122, and a non-radiation pattern portion 123 were separately formed (c).

In this case, a through hole 124 for electrically connecting the radiation pattern portion 121 and the antenna contact portion 122 was disposed at an inner side of a boundary which was formed by the laser etching.

A contact of an electroplating hanger 210 having a diameter of 0.6 mm was inserted into the through hole 124 of a conductive portion, which was formed (marked) by the laser etching, to be remained stationary (not being moved and fixed to an established base) so that the radiation pattern portion 121 and the antenna contact portion 122 were electrically connected to each other.

48 resin molded products 100 were fixed to the plurality (five) of electroplating hangers 210, in which 4 rows of 12 resin molded products each were disposed at the same spacing between the top and bottom of the electroplating hanger 210.

The plurality of electroplating hangers 210, to which the resin molded products 100 were fixed, was fixed to a rack 220 of an electroplating bath 240 and immersed (d).

In this case, 200 g/L of copper sulfate and 60 ml/L of sulfuric acid were dissolved in the electroplating bath 240, and this corresponded to a concentration range equivalent to that of a composition of a typical electrolytic copper plating solution containing copper sulfate.

60 Amin was set to each of the plurality of electroplating hangers 210 fixed to the rack 220 by using the current integration controllers 300, a total current applied to the electroplating bath 240 was set to an average of 2 A for each hanger, and electroplating was performed at a total current of 10 A to form a primary conductive layer 130 on the radiation pattern portion 121 and the antenna contact portion 122 (*e*).

In this case, the electroplating hangers 210, in which an alarm was sounded when the set integration current amount was reached, were sequentially removed from the electroplating bath 240 and washed with water.

Next, forced chemical exfoliation of the metal plating layer 120, which was formed on the non-radiation pattern portion 123 excluding the radiation pattern portion 121 and the antenna contact portion 122, was performed by dipping the resin molded product 100 in an exfoliation bath (not shown), in which sulfuric acid and hydrogen peroxide were mixed in a ratio of 1:1, for about 1 minute to about 5 minutes (f).

Accordingly, an improvement in productivity may be maximized by significantly reducing the working time for the exfoliation of the metal plating layer 120 formed on the non-radiation pattern portion 123.

Continuously, the resin molded products 100, from which the metal plating layer 120 formed on the non-radiation pattern portion 123 was exfoliated, were fixed to the electroplating hangers 210. Then, 60 Amin was set to each of the plurality of electroplating hangers 210 by using the current integration controllers 300, a total current applied to the electroplating bath 240 was set to an average of 2 A for each hanger, and electroplating was performed at a total current of 10 A to form a secondary conductive layer 140 on the radiation pattern portion 121 and the antenna contact portion 122 (*g*).

In this case, a coating layer formed in the exfoliation bath during the exfoliation of the metal plating layer 120 was removed.

Next, the electroplating hangers 210 washed with water after the electroplating were introduced into a nickel electroplating bath 240 filled with a plating solution 230 in the same manner as in the electrolytic copper plating. 15 Amin was set to each of the plurality of electroplating hangers 210 by using the current integration controllers 300 installed in the electroplating bath 240, an average current of 2 A was applied to each electroplating hanger 210, and nickel electroplating was performed at a total current of 10 A to form a nickel plating layer 150 on the radiation pattern portion 121 and the antenna contact portion 122 (*h*).

In this case, the nickel electroplating bath 240 contained a solution including 260 g/L of nickel sulfate, 50 g/L of nickel chloride, and 50 g/L of boric acid, which was the same composition as a typical decorative nickel electroplating solution, at a pH of 4.0 to 5.0 and a temperature of 52° C.

Accordingly, oxidation of the radiation pattern portion 121 and the antenna contact portion 122, which were damaged in the exfoliation bath to remove the metal plating layer 120, was compensated and simultaneously, scratches may be prevented.

Next, the electroplating hangers 210, in which an alarm was sounded when the integration current amount set as described above was reached, were sequentially removed from the electroplating bath 240, and the resin molded products 100 having the nickel plating layer 150 formed thereon were sealed, washed, and dried (i).

INDUSTRIAL APPLICABILITY

Thus, when the intenna was manufactured by the above-described method, productivity may not only be increased by a minimum of two to three times, but also a uniform plating layer may be formed and reliability of plating may be improved. Therefore, the improvement of the quality of the intenna may be promoted and the method may provide higher cost competitiveness than other methods.

The accompanying drawings and detailed description is for example only and for describing the present invention, not for limiting the scope of the present invention, as claimed. Therefore it is appreciated by those who skilled in the art that various changes, modifications and equivalent embodiments will be made without departing from the spirits and scope of the present invention.

SEQUENCE LIST FREE TEXT intenna, antenna, uniform plating layer, reliability of plating

The invention claimed is:

1. A method of manufacturing an intenna having improved reliability of plating by using electroplating, the method comprising steps of:

(a) forming a paint layer on a resin molded product with a primer paint;

(b) forming a metal plating layer on a top surface of the paint layer;

(c) etching the metal plating layer with a laser beam so that a radiation pattern portion, an antenna contact portion, and a non-radiation pattern portion are formed, wherein, by the etching step, electricity flows only to the radiation pattern portion and the antenna contact portion;

(d) hanging the resin molded product on a hanger and dipping the resin molded product in an electroplating bath, wherein the radiation pattern portion and the antenna contact portion are electroplated;

(e) forming a primary conductive layer by electroplating on the radiation pattern portion and the antenna contact portion;

(f) exfoliating the metal plating layer formed on the non-radiation pattern portion in an exfoliating bath, the exfoliating being performed by chemical exfoliation using a mixture of sulfuric acid and hydrogen peroxide;

(g) forming a secondary conductive layer by electroplating on the radiation pattern portion and the antenna contact portion;

(h) forming an electrolytic nickel plating layer on the radiation pattern portion and the antenna contact portion on which the secondary conductive layer is formed; and (i) sealing, washing, and drying the resin molded product on which the nickel plating layer is formed, wherein, when an operating temperature of the paint is 85° C. or less, the paint is composed of 30 wt % to 40 wt % of acetone, 30 wt % to 40 wt % of methyl ethyl ketone, 10 wt % to 20 wt % of cyclohexanone, and 10 wt % to 20 wt % of an acrylonitrile butadiene styrene (ABS) copolymer, and wherein, when the operating temperature of the paint is in a range of 85° C. or more to 240° C. or less, the paint is composed of 30 wt % to 40 wt % of acetone, 30 wt % to 40 wt % of methyl ethyl ketone, 10 wt % to 20 wt % of cyclohexanone, and 10 wt % to 20 wt % of a liquid crystal polymer (LCP) resin.

2. The method of claim 1, wherein, in the step (c), a distance between the non-radiation pattern portion and the radiation pattern portion and antenna contact portion is formed to be in a range of 100 μm to 200 μm to prevent a failure due to a short-circuit phenomenon during electroplating.

* * * * *